US007971686B1

(12) United States Patent
Hayman

(10) Patent No.: US 7,971,686 B1
(45) Date of Patent: Jul. 5, 2011

(54) DOUBLE LATCHED SCAFFOLD CONNECTOR

(75) Inventor: Yates W. Hayman, Walker, LA (US)

(73) Assignee: Excel Modular Scaffold and Leasing Corporation, Plymouth, MA (US)

( * ) Notice: Subject to any disclaimer, the term of this patent is extended or adjusted under 35 U.S.C. 154(b) by 1110 days.

(21) Appl. No.: 11/738,273

(22) Filed: Apr. 20, 2007

(51) Int. Cl.
*E04G 7/00* (2006.01)

(52) U.S. Cl. ..... 182/186.8; 403/49

(58) Field of Classification Search ..... 182/186.7, 182/186.8; 403/49; 292/113, 118
See application file for complete search history.

(56) References Cited

U.S. PATENT DOCUMENTS

| | | | | |
|---|---|---|---|---|
| 835,280 | A | 11/1906 | Haskell | |
| 1,573,866 | A * | 2/1926 | Rogers | 292/113 |
| 3,179,212 | A | 4/1965 | Gostling | |
| 3,195,735 | A | 7/1965 | Jay | |
| 3,268,252 | A | 8/1966 | Rolland | |
| 3,476,425 | A * | 11/1969 | Chartrand | 292/113 |
| 3,482,873 | A | 12/1969 | Pivacek | |
| 3,490,189 | A | 1/1970 | Gostling | |
| 3,817,641 | A | 6/1974 | Steele et al. | |
| 3,879,143 | A | 4/1975 | Gostling | |
| 3,880,533 | A | 4/1975 | Gostling | |
| 3,992,118 | A | 11/1976 | Siegers | |
| 4,039,264 | A | 8/1977 | Sharp | |
| 4,044,523 | A | 8/1977 | Layher | |
| 4,090,798 | A | 5/1978 | Barton | |
| 4,180,342 | A | 12/1979 | Layher | |
| 4,273,463 | A | 6/1981 | Dobersch | |
| 4,369,859 | A | 1/1983 | Smits | |
| 4,445,307 | A | 5/1984 | Puccinelli et al. | |
| 4,586,842 | A * | 5/1986 | Puccinelli | 403/246 |
| 5,078,532 | A * | 1/1992 | Williams | 403/246 |
| 5,620,212 | A * | 4/1997 | Bourne et al. | 292/113 |

FOREIGN PATENT DOCUMENTS

| | | |
|---|---|---|
| FR | 2352194 | 12/1977 |
| GB | 1163533 | 9/1969 |
| GB | 1310529 | 3/1973 |
| NL | 7801928 | 8/1979 |

* cited by examiner

*Primary Examiner* — Alvin C Chin-Shue
(74) *Attorney, Agent, or Firm* — Jones, Walker, Waechter, Poitevent, Carrere & Denegre, LLP

(57) ABSTRACT

An improved scaffold connection is provided, attachable to a vertical scaffold member having a plurality of ring members. The scaffold joint has an upper side and a lower side, and an upper hook section and a lower hook section engagable with the ring members on the vertical scaffold members. The invention includes two latches to lock the joint to two ring members, where the two latches are mechanically connected.

16 Claims, 3 Drawing Sheets

DOUBLE LATCHED SCAFFOLD CONNECTOR

BACKGROUND OF THE INVENTION

1. Field of the Invention

This invention relates generally to connections for scaffolding and, more particularly, to latchable scaffolding connections between horizontal and vertical scaffold members.

2. Background of the Invention

Many different designs have been employed to secure the ends of horizontal scaffold members to vertical scaffold members. Because of a concern for a positive locking arrangement, prior art connections employ a latch assembly, whereby the connection between a horizontal and a vertical member is held in place against an uplifting force by some type of latch. One such joint is disclosed in U.S. Pat. No. 4,445,307, which discloses a connector positioned on a horizontal scaffold member, where the connector has two vertically spaced hook sections. These hook sections couple with two vertically spaced upstanding ring members located on the vertical scaffold member. To withstand an uplifting force, the connector includes a wedge that is driven (generally by a hammer) into position below the upper ring member, thereby latching the connector hook sections against the ring member through a wedging type of action.

A second type of latching connector is disclosed in U.S. Pat. Nos. 5,078,532 and 5,028,164, hereby incorporated by reference. These patents also show a connector positioned on a horizontal scaffold member, where the connector has two vertically spaced hooked sections that couple with two vertically spaced upstanding ring members located on the vertical scaffold member. In this device, the latching of the ring members to the hooked sections is accomplished by a deploying a pivoting member, positioned on the connector, into position below the top ring member. The pivoting member cages or traps the connector to the vertical member, thereby resisting an uplifting force. The pivoting member allows for ease of assembly of a scaffold structure, and the assembled joint retains a degree of play, as this connector lacks the wedging action of the '307 patented device.

By using a two points of attachment between a horizontal and vertical member (the two hooked sections coupled to the two upstanding ring members), the '532 join and the '307 join are more resistive to torsional forces than would be a single ring/hook section embodiment, such as shown in U.S. Pat. No. 4,369,859. However, because the bottom hook of the '532 connector and '307 connector is not latched to the bottom ring member, the connector is still weak when subject to high torsional forces; for instance, it is not recommended that a worker tie onto a horizontal member that is designed only as specified in the '532 patent, as a falling worker will subject that connector to high torsional force and possible connector failure. Hence it is desired to have a scaffold join that is more resistive to torsional forces, that enables a scaffold structure to be easily and quickly erected, and can be used with existing vertical scaffold members.

SUMMARY OF THE INVENTION

Therefore, it is an object of this invention to provide an improved scaffold latch mechanism that latches at two vertically offset points, and which can be quickly and efficiently installed or dismantled without the aid of tools.

Accordingly, an improved scaffold connector is provided that has an upper side and a lower side, and an upper hook section and a lower hook section engagable with the ring members on a vertical scaffold members. The invention includes two latches to lock the connector to two ring members, where the two latches are mechanically coupled.

DETAILED DESCRIPTION

Figure 1A:
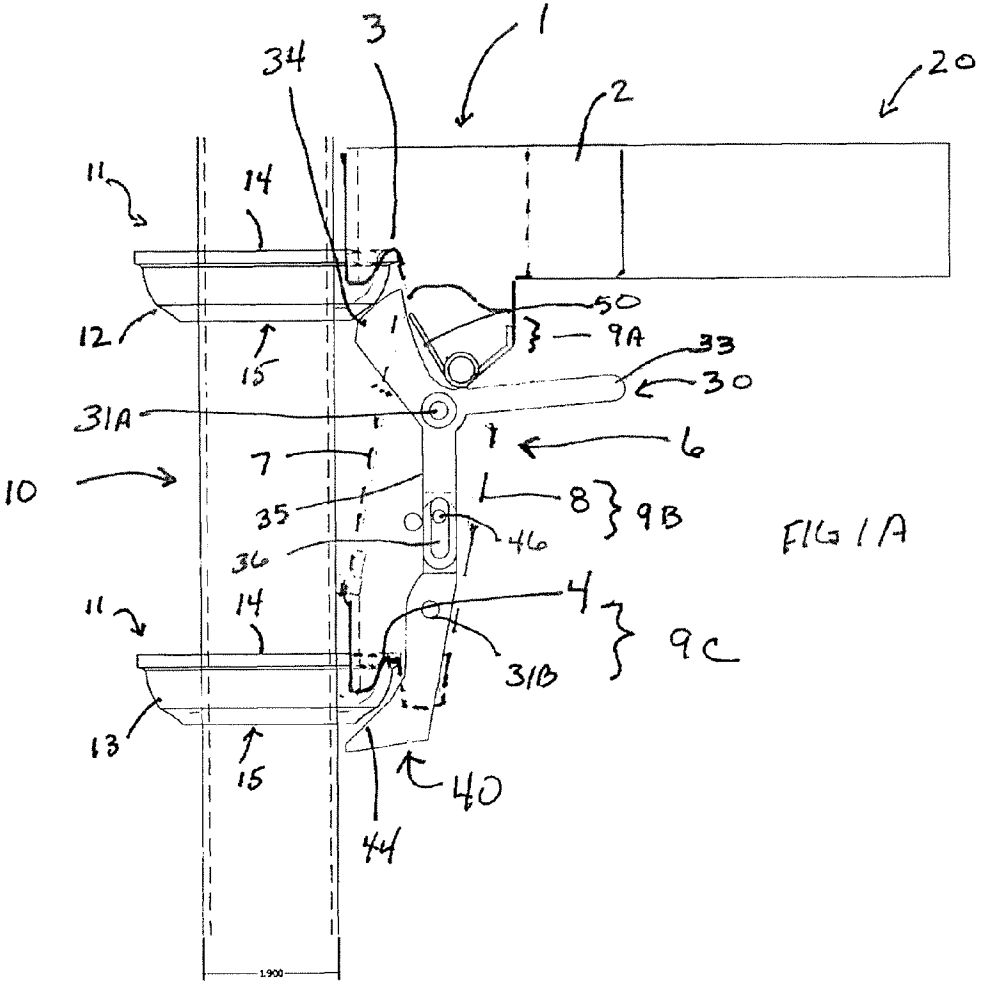
FIG. 1A is a side view of scaffold joint shown attached to a vertical scaffold member in a latched configuration, where the leg portion is shown cutaway.

Shown in FIG. 1A is a scaffold connector 1, joining a vertical scaffold member 10 with a horizontal scaffold member 20. Positioned on the vertical scaffold member 10 is a plurality of ring members 11. In general, the vertical scaffold member 10 will have a series of ring members 11 positioned at regular intervals along the length of the vertical member. Ring members 11 are positioned in a vertically spaced apart relationship on the vertical scaffold member 10. Shown in FIG. 1A are upper ring member 12, and lower ring member 13. Ring members have an upper side 14 and a lower side 15. As shown, ring members 11 are upwardly curved cup shaped members. Alternative ring members can be seen in U.S. Pat. Nos. 4,044,523 and 4,039,264 hereby incorporated by reverence The connector 1 is fixedly attached to the horizontal scaffold member 20, preferably by welding. As shown, connector 1 has a connector body with a top housing 2 shaped to accept a horizontal scaffold member 20. Protruding from the top front edged of the connector body is upper hook section 3. Downwardly projection from the housing 2 is leg portion 6. Leg portion has two opposing sides, a front edge 7 and a rear edge 8, and terminates in lower hook section 4. As shown, hook portion has a front lip and a rear lip formed by the leg portion, forming a "U" shaped channel between the two lips. A single lip or tooth can be used (e.g. terminate the back lip section of the leg portion before the hook section) but this is not preferred as the double lip results in a more stable attachment. A cavity is formed between the two opposing sides. The opposing sides of the leg portion 6 on the rear edge 8 are folded inwardly and joined at two locations 9A and 9B (generally by welding) on the read edge 7. These joins provide strength and provide support for latch members and resilient bias means. Upper 3 and lower 4 hook sections are adapted to engage with the ring members, as shown, upper side 14 portion of upper ring member 12 and lower ring member 13 engage hook portions. At the lower hook section 4, the leg portion's sides are flared outwardly (shown as region 9C) providing for added stability when the lower hook section 4 is engaged with a ring member.

Within the cavity between the opposing sides are two latch members, upper latch member 30 and lower latch member 40. Latch members are secured within the cavity by pins 31A and 31B, and pivot on these pins. Upper latch member is "Y" shaped with the leg 33 of the "Y" functioning as a handle, the upper leg of the "Y" containing the latch surface 34, and the lower leg 35 mechanically coupled with the lower latch member 40. The lower latch member is L" shaped with the bottom of the "L containing the latch surface 44, and the upper leg of the "L mechanically coupled to the upper latch member 30. As shown, the two latch members are coupled by a pin 46 on one latch (as shown, the lower latch) engaging a slot 36 on the other latch (as shown. the upper latch). Through this mechanical coupling, joint movement of the two latch members can be effectuated through manipulation of the handle 33 alone. The dual latch mechanism is biased into a "latched" or closed configuration by a resilient biasing means, here a spring 50 position above and operating on upper latch 30.

Operation of the Latch

Figure 1B:
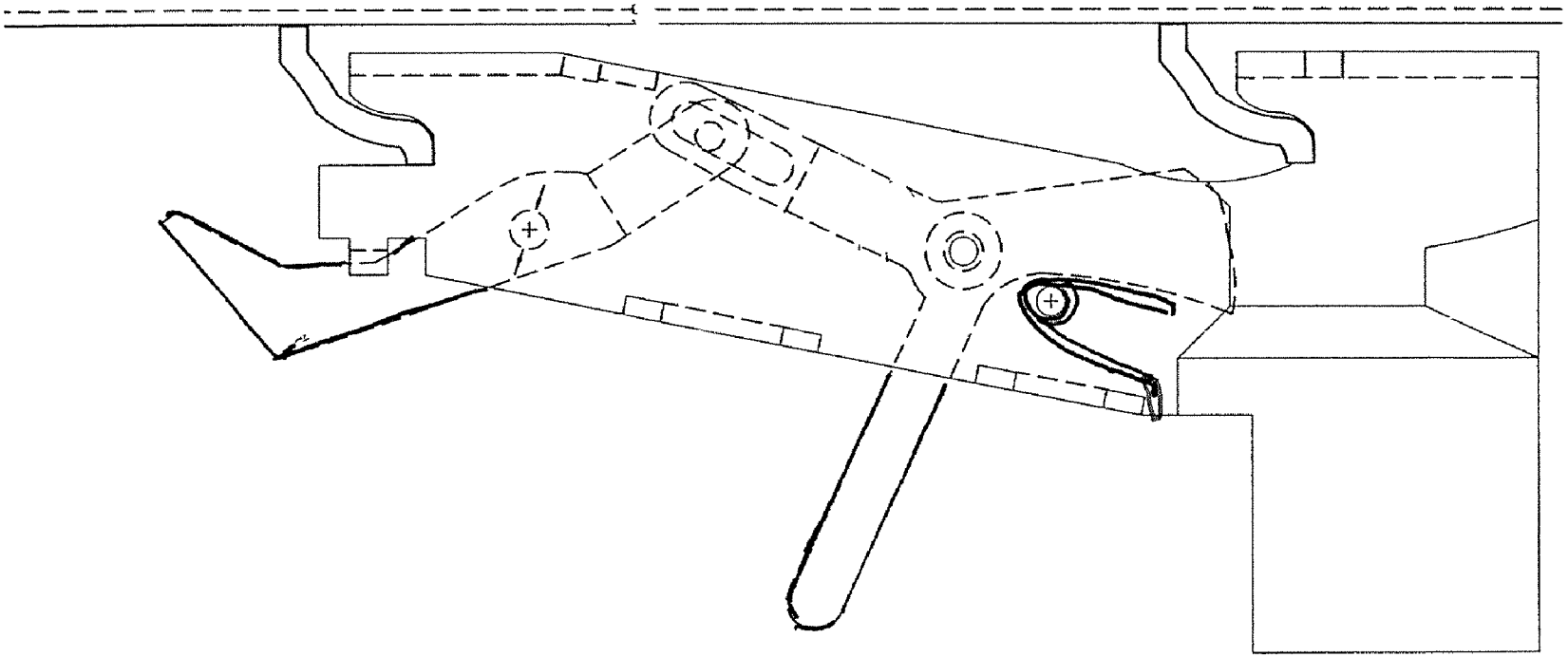
FIG. 1B is a side cross sectional view of one embodiment of the scaffold connector in an unlatched configuration invention.

As shown in FIG. 1A, in a closed or latched configuration, latch surface 34 of upper latch member 30 is positioned in a first position, below the upper hook section 3 and below the lower surface 15 of the upper ring member 30; lower latch member 40 latch surface 44 is positioned in a first position, beneath lower hook section 4 and under lower surface 15 of lower ring member 13, thereby securing the horizontal scaffold member 20 to the vertical scaffold member 10 and resisting upward movement of the horizontal scaffold member. To "unlatch" the connector, the operator depresses or pivots the handle 33 of upper latch member 30 downwardly, thereby compressing spring 50. In response to this action, upper latch member 30 rotates about pin 31A and the upper latch surface 34 rotates to a second position away from upper ring member 12, thus unlatching the upper latch member 30. Since the upper latch member 30 is mechanically coupled to lower latch 40, the rotation of the upper latch member 30 results in the rotation of the lower latch member 40 about its supporting pin 31B (as constructed, the lower latch member 40 rotates in the opposite direction from that of the upper latch member 30). Rotation of the lower latch member 40 moves the lower latch surface 44 away from the lower ring member 13, thus unlatching the lower latch member 40. In the unlatched configuration, shown in FIG. 1B, the horizontal scaffold member can be uplifted and removed from the vertical scaffold member.

To attach the connector 1 to a vertical scaffold member 10, the operator can depress the handle 30 to rotate the two latches away from the locked or latched position, (the connector 1 is in a "normally latched" configuration by operation of the spring 50); however, in general, this is not necessary. The operator can simply place the hook sections 3 and 4 of the connector on the respective ring members and press down. The action of pressing down will move the latch surfaces 34 and 44 away from the latched position and compress the resilient biasing member 50. When the hook sections 3 and 4 are engaged to the ring members, the latch members 30 and 40 will spring back into the latched position by operation of the resilient biasing means 50. That is, the connector can be "snapped" into place on a vertical scaffold member, making for ease and rapidity in assembly of a scaffold structure.

Figure 2:
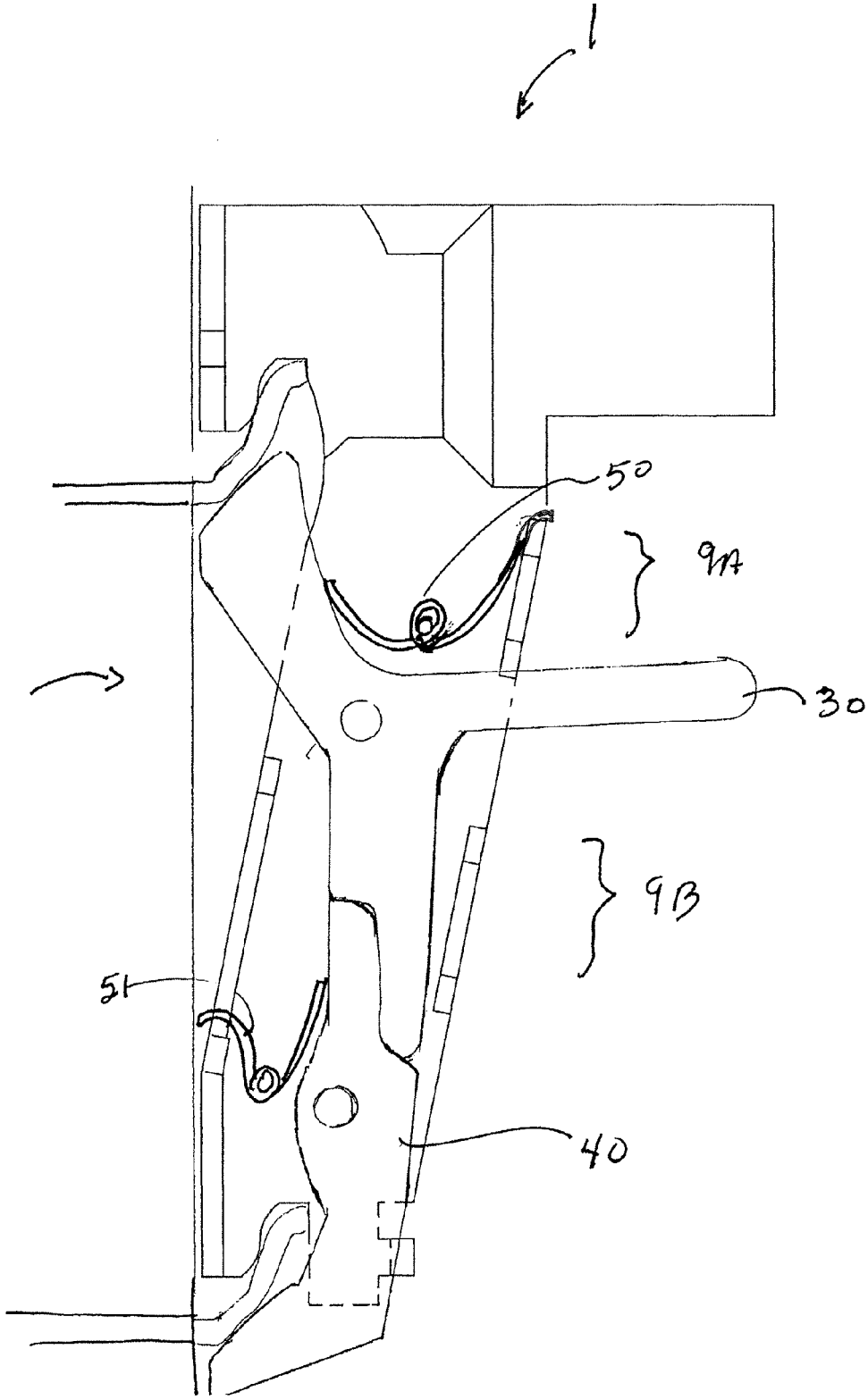
FIG. 2 is side view cross sectional view of another embodiment of the scaffold connector in an latched configuration.

As shown, the dual latches are mechanically coupled by a pin and slot configuration. The two latch members may be mechanically coupled simply by a suitable overlap of the latch members, such as shown in FIG. 2. However, this arrangement is not preferred, as a second resilient biasing means 51 is needed in this configuration to bias the lower latch member 40 into an open position. Other embodiments are feasible for the design shown in FIG. 1A, such as placing the handle 33 on the lower latch member, and lifting up the handle to operate the mechanism; locating the spring or resilient biasing means in the leg portion to bias either the lower latch or upper latch member into a closed or latched configuration. Alternatively, the leg portion 6 can be extended further downward to allow the lower latch member 40 to be pivotally connected to the leg portion 6 below the lower hook section 4, so that the lower latch member 40 would rotate in the same direction as the upper latch member 30. In this embodiment, both lower and upper latch members can have handles, and the two latch members may be mechanically coupled by using a bar pivotally joined to both handles, such as through the pin/slot arrangement discussed above or other means.

Instead of a leg composed of two opposing sides with a cavity between, the leg portion 6 may be a single plate with the latches 30 and 40 pivotally pinned to the leg portion 6. However, this arrangement is not preferred, as the latches are exposed and can be more readily damaged. Other embodiments of the invention will occur to those skilled in the art, and are intended to be included within the scope and spirit of the following claims.

As can be seen, an improved scaffold connection is provided which more securely locks a horizontal scaffold member to a vertical scaffold member. The improved connection is versatile in its application, and allows for continued use of existing vertical scaffold members equipped with ring members.

I claim:

1. A scaffold connector, comprising:

a connector body having a connector housing and a leg portion, said connector body having (a) an upper and lower hook sections disposed on said connector body in a vertically spaced relationship, each upper and lower hook section adapted to engage a ring member on a vertical scaffold member, and (b) an upper latch member and a lower latch member pivotally mounted to said leg portion, said upper and lower latch members each having a latch surface, one of said latch members having a handle section, said handle section movable from a first position to a second position, said lower and said upper latch members being coupled to each other and each pivoting in response to movement of said handle section from a first latched position where said upper and lower latch surface are near said upper and lower hook sections respectively, to a second unlatched position where said upper and lower latch surfaces are distant from said upper and lower hook sections respectively.

2. The scaffold connector of claim 1, further including a scaffold frame member, said scaffold frame member fixedly attached to said connector housing opposite said upper hook section.

3. The scaffold connector of claim 1 further having a first biasing means to bias at least one of said upper and lower latch members into said a first latched position.

4. The scaffold connector of claim 1 wherein the coupling of said upper and lower latch members is mechanical, said mechanical couple achieved by one of said upper and lower latch members being slidably engaged with the other of said upper and lower latch members.

5. The scaffold connector of claim 1 wherein said leg portion contains a cavity and said upper and lower latch members are partially positioned in said cavity.

6. The scaffold connector of claim 5 where one of said upper and said lower latch members has a pin that is slidably engaged in a slot positioned in the other of said upper and lower latch members.

7. The scaffold connector of claim 3 further having a second biasing means, where said first biasing means biases the upper latch member into said first latched position, and said second biasing means biases the lower latch member into said first latched position.

8. The scaffold connector of claim 1 wherein said first and second latching members pivot in opposite directions.

9. The scaffold connector of claim 1 wherein said upper hook section is positioned on said connector body and said lower hook section is positioned on said leg portion.

10. A scaffold connector, comprising:

a connector body having a connector housing and a leg portion, a cavity formed in said leg portion, said scaffold connector having (a) an upper and lower hook sections disposed on said connector body in a vertically spaced relationship, each upper and lower hook section adapted to engage a ring member on a vertical scaffold member, and (b) an upper latch member and a lower latch member, said upper and said lower latch members each having a respective upper and lower latch surface, each of said upper and lower latch members pivotally mounted within said cavity in said leg portion in a vertically spaced relationship, said upper latch member pivoting between a first latched position where said upper latch surface is positioned below and near said upper hook section and a second unlatched position where said upper latch surface is positioned away from said upper hook section; said lower latch member pivoting between a first latched position where said lower latch surface is positioned below and near said lower hook section and a second unlatched position where said lower latch surface is positioned away from said lower hook section; one of said latch members having a handle section, said handle section movable from a first position to a second position, said lower and said upper latch members being coupled to each other and each pivoting in response to movement of said handle section from the first latched position to the second unlatched position; a first biasing positioned in said cavity, said first biasing member biasing one of said upper or lower latch members into a latched position.

11. The scaffold connector of claim 10 where said first biasing means biases said lower latch member.

12. The scaffold connector of claim 10 where said first biasing means biases said upper latch member.

13. The scaffold connector of claim 10 wherein the coupling of said upper and lower latch members is mechanical, said mechanical couple achieved by one of said upper and lower latch members being slidably engaged with the other of said upper and lower latch members.

14. The scaffold connector of claim 13 where one of said upper and said lower latch members has a pin that is slidably engaged in a slot positioned in the other of said upper and lower latch members.

15. The scaffold connector of claim 10 further having a second biasing means, where said first biasing means biases the upper latch member into said first latched position, and said second biasing means biases the lower latch member into said first latched position.

16. The scaffold connector of claim 10 wherein said upper hook section is positioned on said connector body and said lower hook section is positioned on said leg portion.

* * * * *